US007051395B2

(12) United States Patent
Domke

(10) Patent No.: US 7,051,395 B2
(45) Date of Patent: May 30, 2006

(54) DISPOSABLE AND FOLDABLE TOOTHBRUSH

(76) Inventor: Todd Philip Domke, 43458 Rivergate Dr., Clinton Township, MI (US) 48038

( * ) Notice: Subject to any disclaimer, the term of this patent is extended or adjusted under 35 U.S.C. 154(b) by 0 days.

(21) Appl. No.: 10/783,433

(22) Filed: Feb. 23, 2004

(65) Prior Publication Data

US 2005/0183226 A1 Aug. 25, 2005

(51) Int. Cl.
*A46B 7/02* (2006.01)

(52) U.S. Cl. ..... 15/203; 15/202; 15/167.1; 15/185

(58) Field of Classification Search ..... 15/167.1, 15/201–203, 185, 172, 160, 159.1
See application file for complete search history.

(56) References Cited

U.S. PATENT DOCUMENTS

| | | | | | |
|---|---|---|---|---|---|
| 1,307,530 | A | * | 6/1919 | Wolf | 15/203 |
| 3,707,013 | A | * | 12/1972 | Erkers | 15/167.1 |
| D322,893 | S | * | 1/1992 | Kihara | D4/104 |
| 5,673,454 | A | * | 10/1997 | Quintanilla et al. | 15/167.2 |
| 6,643,887 | B1 | * | 11/2003 | Foley et al. | 15/185 |

* cited by examiner

*Primary Examiner*—John Kim
*Assistant Examiner*—Laura C Cole
(74) *Attorney, Agent, or Firm*—John P. Halvonik

(57) ABSTRACT

A disposable toothbrush that can folded and unfolded upon it self is shown and described. The toothbrush is constructed of two folding sections that each contain bristles each half can join to the other half and so provide a rigid toothbrush for brushing. Prior to use, the toothbrush is in the unfolded position so that the bristles in each of the brush lie flat. This orientation presents a toothbrush with very narrow width for ease of storage.

2 Claims, 1 Drawing Sheet

DISPOSABLE AND FOLDABLE TOOTHBRUSH

SUMMARY OF THE INVENTION

The invention relates to the field of toothbrushes, and in particular, to a toothbrush that is both disposable and can folded and unfolded upon it self. The toothbrush is constructed of two folding sections that each contain bristles so that when the toothbrush is opened up and locked into place each half with bristles can join to the other half and so provide a complete set of bristles for brushing. Prior to use, the toothbrush is in the unfolded position so that the bristles in each of the brush lie flat. This orientation presents a toothbrush with very narrow width and so it may be easily stored in a very narrow space.

It is an object of the invention to provide a disposable toothbrush that may be easily transported and can be easily stored into small storage areas such as the user's wallet.

Another object is to provide a disposable toothbrush that can be unfolded into a usable position and can be folded into a very narrow orientation so that it will present a very narrow width when it is to be stored.

Other objects of the invention will be apparent to those skilled in the art once the invention is shown and described.

DESCRIPTION OF PREFERRED EMBODIMENT

Figure 1:
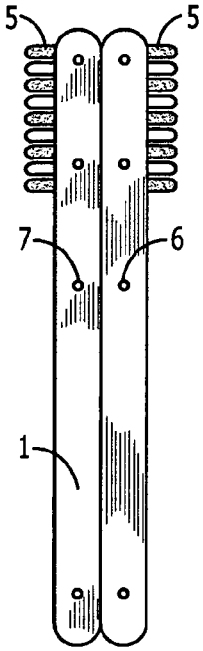
FIG. 1 overall construction of the toothbrush with the halves unfolded.
Figure 2:
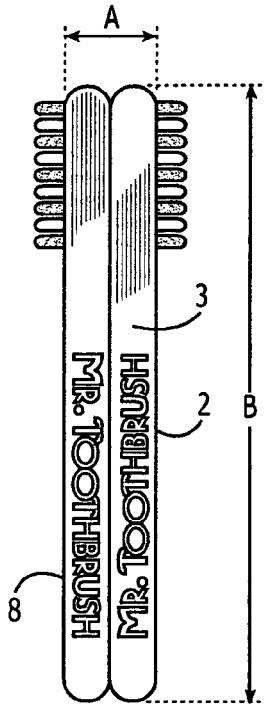
FIG. 2 front view of FIG. 1.

The overall construction of the toothbrush is shown m unfolded position in FIG. 1. There is a left half 1 and a right half 2. Each half has a handle section and set of tufts at one end so that the two halves may be joined to one another to form the whole brush. When the brush is sold, and before the brush is used, the two halves are in the unfolded position shown here. This will minimize the thickness of the brush so that it may be kept in an area with narrow size like that of a wallet or billfold. 8 shows the handle in FIG. 2. 12 shows a tuft in FIG. 4 that comprises a plurality of bristles.

Before use, the toothbrush may be stored in this position with the two halves unfolded and joined along the spine 3 so that the left and right halves cam be folded against one another. When in this unfolded position, the toothbrush will present a very narrow thickness (thickness of a half shown by line D in FIG. 3).

Because of this narrow thickness, the toothbrush can be stored in a very narrow space. It is likely to rest upon the bottom edge of the handle 1 and so remain on a store shelf in an upright position. A large number of such toothbrushes and associated packaging may be stored in this manner, by resting upright, upon a store shelf.

Figure 3:
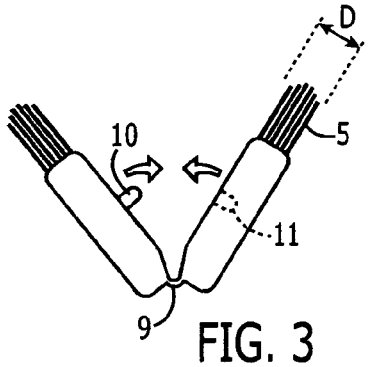
FIG. 3 end view of toothbrush showing folding action of halves.
Figure 4:
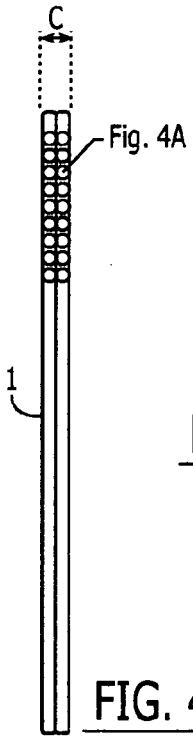
FIG. 4 side view of brush when halves are folded upon one another.
Figure 4A:
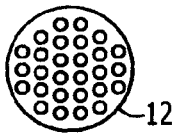

Such a brush when in the unfolded position would be of such narrow thickness so that it could be carried within the wallet of the user. The brush would preferably be about 3" or 4" in length (length shown by arrow B in FIG. 2) and perhaps an inch or so in width (width shown by arrow A in FIG. 2). However, the thickness of the brush could be made to less than an inch (arrow D in FIG. 3; arrow C in FIG. 4 shows the thickness of the brush when in the folded up position and ready to be used).

Each half of the brush may be described as having a tuft end 5 and a handle end 6. The tuft end contains tufts and the handle end is used to hold the brush. The length of the handle will thus define a line 3 that runs parallel to each of the handles. And the two halves of the brush will pivot along a line that is parallel to this line. So that each brush half will contain both bristles and a handle.

It is preferred that the bristle end of each half be a single row of bristles so that when in the stored flat position (see FIG. 1) the toothbrush will only be one bristle thick. In other words it will present a line of single bristles. Importantly, each set of bristles 5 on each half will project outward from the handle in the unfolded position. This orientation can be seen in FIG. 1.

When the halves are folded in connection with one another they will form a bristle end that is only two bristles wide (see FIG. 4), in other words each single row of bristles has joined with the other to make a set of bristles two rows wide. In the illustration, each bristle end is a single row of 9 bristles, although the actual number of bristles may vary (less than or more than 9) it is preferred that there only be one row of bristles for each bristle half 5.

When the halves are joined together the two sets of bristles will join to form one bristle head that is used to brush the teeth. Again in the illustration, the bristle head as completed is 2×9 but other configurations are possible so long as the bristle head is two bristles wide when joined.

Likewise, the handle ends will join together to form one handle. FIG. 3 shows the action of joining as seen looking down the length of the brush so that one can see each set of bristles joining with the other set so as to form the bristle head.

There is a pivoting means shown at 9. This pivoting means is in connection with both the left and right halve of the toothbrush Such a pivot means should allow each halve of the brush to pivot in relation to the other. This connecting means may be referred to as a hinge since it acts in the same manner as a hinge would in allowing the halves to pivot in relation to one another. The connecting means would preferably be in connection with a portion of the handle portion of the brush although it is also possible that the hinge can be connected to the bristle portion of each half.

There is a locking means shown as 10 and 11 in FIG. 1. This means may be as simple as a male and corresponding female shaped portion that will join to one another by friction. The male or pin 10 member should be of size and shape to allow the pin to fit in the hole or female member 11 and to secure the halves into a fixed relationship when the pin is locked into the hole. A male/female type of connection may be used for this locking means or some other means may be used. Whatever means is used, it should allow the halves to be joined to one another and locked into place so that, when the halves are connected, the toothbrush will be of rigid form and the two halves will not separate from one another when the toothbrush is in use.

The connection formed by 10 and 11 may be unlocked by the user when the toothbrush is not in use. This unlocking may be simply the action of the user pulling apart the two halves and so overcoming the frictional force of the male/female connection used or whatever type of connection is used.

It is preferred that the handle of the brush be made of plastic and molded. It is thought that the bristles would be best made of nylon although other types of materials are possible for the handle and bristles without departing from the spirit of the invention. Item 12 in FIG. 4 shows a close up view of a single bristle which of course may consist of numerous "hairs" or other thread like members.

Figure 5:
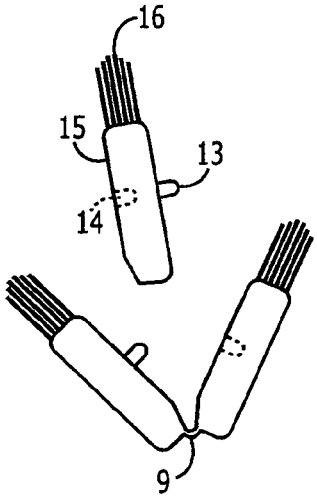
FIG. 5 view of brush with optional intermediate member between the halves.

An intermediate portion 15 may be used in addition to the two halves. The intermediate portion would be of similar construction to the halves 6 and 7, but it would not be in physical connection with them. In this case, it would have a second set of male/female shaped members (shown as 13 and 14 in FIG. 5) that would join to the corresponding male and female members on the halves so that the intermediate section may be joined to the two halves and so construct a tooth brush that is 3 bristles in width and of course would have greater width and thickness than in the case with just the two halves.

I claim:

1. A disposable toothbrush comprising: a first part having left and right halves, each of said halves having a tuft end and a handle end and having a longitudinal axis running from said tuft end to said handle end and a width running perpendicular to said longitudinal axis; each tuft end having a row of tufts running parallel to said longitudinal axis; each of said halves having a means to allow said halves to pivot in relation to one another so that when said halves are pivoted, a set of two parallel rows of tufts will be formed; a set of male and female interlocking portions are in connection with each halve so that said halves may be connected by use of said male and female interlocking portions; a second part having a handle end and a tuft end and having a longitudinal axis running from said tuft end to said handle end, said second part having a row of tufts at said tuft end and running parallel to said longitudinal axis of said second part, said second part having one set of male interlocking portions and a set of female interlocking portions, so that when said interlocking portions of said second part are joined to those interlocking portions of said first part a set of three parallel rows of tufts will be formed.

2. The apparatus of claim 1, wherein the combined width of said left and right halves is about 1".

* * * * *